US006511240B2

(12) United States Patent
Yamada

(10) Patent No.: US 6,511,240 B2
(45) Date of Patent: Jan. 28, 2003

(54) ROLLED-PAPER HOLDING MECHANISM AND A PRINTER INCLUDING SAME

(75) Inventor: Masahiko Yamada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 5 days.

(21) Appl. No.: 09/736,000

(22) Filed: Dec. 14, 2000

(65) Prior Publication Data

US 2001/0014242 A1 Aug. 16, 2001

(30) Foreign Application Priority Data

Dec. 15, 1999 (JP) ..... 11-356513

(51) Int. Cl.[7] ..... B41J 11/48; B41J 17/06; B41J 11/50; B41J 11/26

(52) U.S. Cl. ..... 400/594; 400/516; 400/593; 400/605; 400/613; 400/614

(58) Field of Search ..... 400/593, 594, 400/586, 605, 613, 614

(56) References Cited

U.S. PATENT DOCUMENTS

| | | | | |
|---|---|---|---|---|
| 4,079,826 A | * | 3/1978 | Shaw | 197/133 |
| 4,204,180 A | | 5/1980 | Usui et al. | |
| 4,494,706 A | | 1/1985 | Becherer et al. | |
| 5,174,518 A | | 12/1992 | Hongo et al. | |
| 5,502,477 A | * | 3/1996 | Osada et al. | 347/176 |
| 5,566,906 A | | 10/1996 | Kamada et al. | |
| 5,820,068 A | | 10/1998 | Hosomi et al. | |
| 5,887,999 A | * | 3/1999 | Smith et al. | 400/621 |
| 6,203,223 B1 | * | 3/2000 | Nakayama et al. | 400/605 |
| 6,068,419 A | * | 5/2000 | Shiozaki et al. | 400/582 |
| 6,113,293 A | * | 9/2000 | Schanke et al. | 400/621 |
| 6,118,469 A | * | 9/2000 | Hosomi | 347/222 |

FOREIGN PATENT DOCUMENTS

| | | |
|---|---|---|
| EP | 0 649 808 A1 | 4/1995 |
| EP | 0 794 064 | 9/1997 |

OTHER PUBLICATIONS

IBM Technical Disclosure Bulletin 700 IBM Technical Disclosure Bulletin 38 (Sep. 1995), No. 9, Armonk, NY, US vol. 38 No. 09 pp. 129–130.

IBM Technical Disclosure Bulletin (May 1994), Vo. 37, No. 05 pp. 195–196.

Patent Abstracts of Japan 58–116184 (Jul. 1983) Fujitsu Ltd, Shidai "Paper End Detecting Device".

Patent Abstracts of Japan 59–143671 (Aug. 1984) Tokyo Electric Co. Ltd, Takada "Paper Detector for Printer".

Patent Abstracts of Japan 05–147328 (Jun. 1993) ALPS Electric Co Ltd, Kanda "Method for Detecting Remaining Paper in Printer".

Unexamined Japanese Utility Model Publication Sho. 61–3872 (Feb. 1986).

Unexamined Japanese Utility Model Publication Hei. 1–14597 (Apr. 1989).

Patent Abstract of Japan vol. 2000, No. 03, Mar. 30, 2000 & JP 11 349197 A (Toshiba Tec Corp.).

Patent Abstract of Japan vol. 1997, No. 07, Jul. 31, 1997 & JP 09 086731 A(Oki Electric Ind Co Ltd.).

* cited by examiner

*Primary Examiner*—John S. Hilten
*Assistant Examiner*—M P Crenshaw
(74) *Attorney, Agent, or Firm*—Nixon & Vanderhye P.C.

(57) ABSTRACT

A miniaturized rolled-paper holding mechanism is capable of detecting the residual quantity of rolled-paper in both horizontally and vertically installed states of a printer. The rolled-paper holding mechanism includes a rolled-paper holder, a holder cover, a positioning member, and a residual-paper-quantity sensor. The positioning member is structured such that, as the holder cover is opened or closed, the inclination angle of the positioning member is varied with respect to a second-bottom-portion inclined surface formed in the rolled-paper holder. Further, a second positioning groove—which, when the holder cover is closed, can be contacted with rolled-paper R having a given diameter—is formed between the positioning member and the second-bottom-portion inclined surface of the rolled-paper holder.

8 Claims, 5 Drawing Sheets

ROLLED-PAPER HOLDING MECHANISM AND A PRINTER INCLUDING SAME

BACKGROUND OF THE INVENTION

1. Field of the Invention

The present invention relates to a receipt-issuing printer for use in, for example, a POS (Point-Of-Sale) system. In particular, the present invention relates to a printer which can be selectively arranged horizontally or vertically and which, in either of the horizontal or vertical arrangement thereof, is capable of detecting the residual quantity of rolled-paper.

2. Description of the Related Art

Conventionally, as a printer of the above type, there is known a printer which executes given printing on a roll of recording paper and, after printing, cuts the printed recording paper in order to issue the same as a receipt. Also, as a printer of this type, there is known a printer which can be selectively installed or arranged horizontally or vertically.

The printer of this type, as shown in FIG. 6, includes a box-shaped rolled-paper holder 101 capable of storing rolled-paper R therein. The printer is structured so that by opening and closing a holder cover 103, disposed in one end portion 102 of the rolled-paper holder 101, the rolled-paper R can be inserted into or taken out from the rolled-paper holder 101.

The rolled-paper holder 101 includes a residual-paper-quantity sensor (not shown) which is used to detect the residual quantity of rolled-paper R. The residual-paper-quantity sensor is structured so that when a sensor element—formed so as to be pressed against the end face of the rolled-paper R— is inserted into the hollow core portion 104 of the rolled-paper R due to the reduced diameter of the rolled-paper R, a limit switch is operated thereby signaling that the residual quantity of the rolled-paper R is small.

Also, the above-mentioned rolled-paper holder 10 includes, in every installation direction, a plurality of grooves which can be used by the residual-paper-quantity sensor for detection of the residual quantity of the rolled-paper R. When the printer is installed horizontally with the bottom portion 105 of the rolled-paper holder 101 facing downward, the rolled-paper R having a little residual quantity drops into horizontal-installation groove 106 formed in the bottom portion 105 of the rolled-paper holder 101. In this state, the residual-paper-quantity sensor is able to detect the residual quantity of rolled-paper R.

On the other hand, when the printer is installed vertically with the end portion 102 of the rolled-paper holder 101 facing downward, the rolled-paper R having little residual quantity drops into vertical-installation groove 107 formed in the end portion 102 of the rolled-paper holder 101. In this state, the residual-paper-quantity sensor is able to detect the residual quantity of rolled-paper R.

3. Problems to be Solved by the Invention

Generally, since this type of printer is designed to use rolled-paper R having several kinds of diameters, it must be sized based on the rolled-paper having the largest diameter. That is, in order to store rolled-paper in the rolled-paper holder, the opening of the rolled-paper holder must be sized so that when it is opened it corresponds to the size of the rolled-paper having the largest diameter. Further, the portion of the rolled-paper holder for storing the rolled-paper must be formed so as to correspond in size to the rolled-paper having the largest diameter.

In the above-mentioned conventional printer as shown in FIG. 6, however, it is difficult to obtain miniaturization. Even when attempting to minimize the storing space of the rolled-paper holder 101, the vertical-installation groove 107 is still formed in the vicinity of the support shaft of the holder cover 103. Therefore, the storing space of the rolled-paper holder 101 must be enlarged by an amount equivalent to the vertical-installation groove 107. Accordingly, there is a limit to miniaturization of the rolled-paper holder 101 and thus to the printer itself.

SUMMARY OF THE INVENTION

The present invention aims at solving the above technical problems found in the conventional printer. Accordingly, it is an object of the invention to miniaturize a printer which is capable of detecting the residual quantity of rolled-paper in either of its horizontally or vertically installed states.

In order to attain the above and other objects and advantages, according to a first aspect of the invention, there is provided a rolled-paper holding mechanism, including: a rolled-paper holder capable of storing therein rolled-paper having a given diameter;

a holder cover disposed on said rolled-paper holder such that said holder cover can be opened and closed by moving about a first pivot;

a groove-like guiding portion formed in said rolled-paper holder, said rolled-paper being located on said groove-like guiding portion when said rolled-paper has a small diameter which is smaller than said given diameter; a paper sensor for detecting a remaining amount of said rolled-paper, said paper sensor provided by the side of said groove-like guiding portion; a retractable positioning member pivotally supported on a second pivot provided in the vicinity of said first pivot, said positioning member being movable together with said holder cover, and forming part of said groove-like guiding portion when said holder cover is closed.

According to the first aspect of the invention, for example, a position—which is present within the vertically arranged rolled-paper holder and at which the residual-paper-quantity sensor is able to detect the rolled-paper—is set as the second position, the rolled-paper is inserted into the rolled-paper holder, and the holder cover is closed. As the diameter of the rolled-paper decreases during use, the rolled-paper is held in the second positioning groove which is formed between a given portion of the rolled-paper holder and the positioning member. Due to this arrangement, there is no need to form a vertically arranged groove in the rolled-paper holder. Also, since the positioning member is rotated about the peripheral portion of the support shaft of the holder cover, the positioning member can be prevented from blocking the storing space of the rolled-paper holder.

Therefore, according to the first aspect of the invention, a storing space that is matched in size to the rolled-paper having the largest diameter can be formed within the rolled-paper holder. This makes it possible to reduce the size of a rolled-paper holding mechanism which is capable of detecting the residual quantity of the rolled-paper in both horizontally arranged and vertically arranged states.

Also, according to a second aspect of the invention, in rolled-paper holding mechanism as set forth in the first aspect of the present invention, said second pivot is provided at an end of said retractable positioning member, and said rolled-paper holding mechanism further includes:

an engagement shaft formed at an opposite end to said end of said retractable positioning member, an engagement hole provided with said holder cover, said engagement shaft being engaged in said engagement hole.

Further, according to a third aspect of the invention,

A rolled-paper holding mechanism as set forth in first aspect of the invention, said rolled-paper having said small diameter is located on said groove-like guiding portion when said rolled-paper holding mechanism is mounted in a vertical attitude, said rolled-paper holding mechanism further includes a second groove-like guiding portion formed in the rolled-paper holder, wherein said rolled-paper having said small diameter is located on said second groove-like guiding portion when said rolled-paper holding mechanism is mounted in a horizontal attitude.

Still further, according to a fourth aspect of the invention, in a rolled-paper holding mechanism as set forth in the second aspect of the present invention, said rolled-paper having said small diameter is located on said groove-like guiding portion when said rolled-paper holding mechanism is mounted in a vertical attitude, said rolled-paper holding mechanism further includes a second groove-like guiding portion formed in the rolled-paper holder, wherein said rolled-paper having said small diameter is located on said second groove-like guiding portion when said rolled-paper holding mechanism is mounted in a horizontal attitude.

Still further, according to a fifth aspect of the invention, a rolled-paper holding mechanism as set forth in the second aspect of the present invention, further includes:

a rolled-paper holding mechanism as set forth in claim 1, and a printing mechanism adapted to print on recording paper pulled out from said rolled-paper held in said rolled-paper holder. Still further, according to a sixth aspect of the invention, a rolled-paper holding mechanism as set forth in the fifth aspect of the present invention further includes:

a cutting mechanism that is adapted to cut said recording paper after said recording paper has passed through said printing mechanism.

According to the present invention, the above-mentioned rolled-paper holding mechanism, printing device, and cutter device are combined together. Because of this combined arrangement, a printer—which is capable of detecting the state of the residual quantity of the rolled-paper whether the printer is installed horizontally or vertically—can be reduced in size and, especially, a printer used to issue a receipt can be miniaturized.

BRIEF DESCRIPTION OF THE DRAWLS

The above and other objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF PREFERRED EMBODIMENTS OF THE INVENTION

Now, with reference to the accompanying drawings, a detailed description will be given of a preferred embodiment of a rolled-paper holding mechanism and a printer including the same according to an embodiment of the invention.

Figure 1:
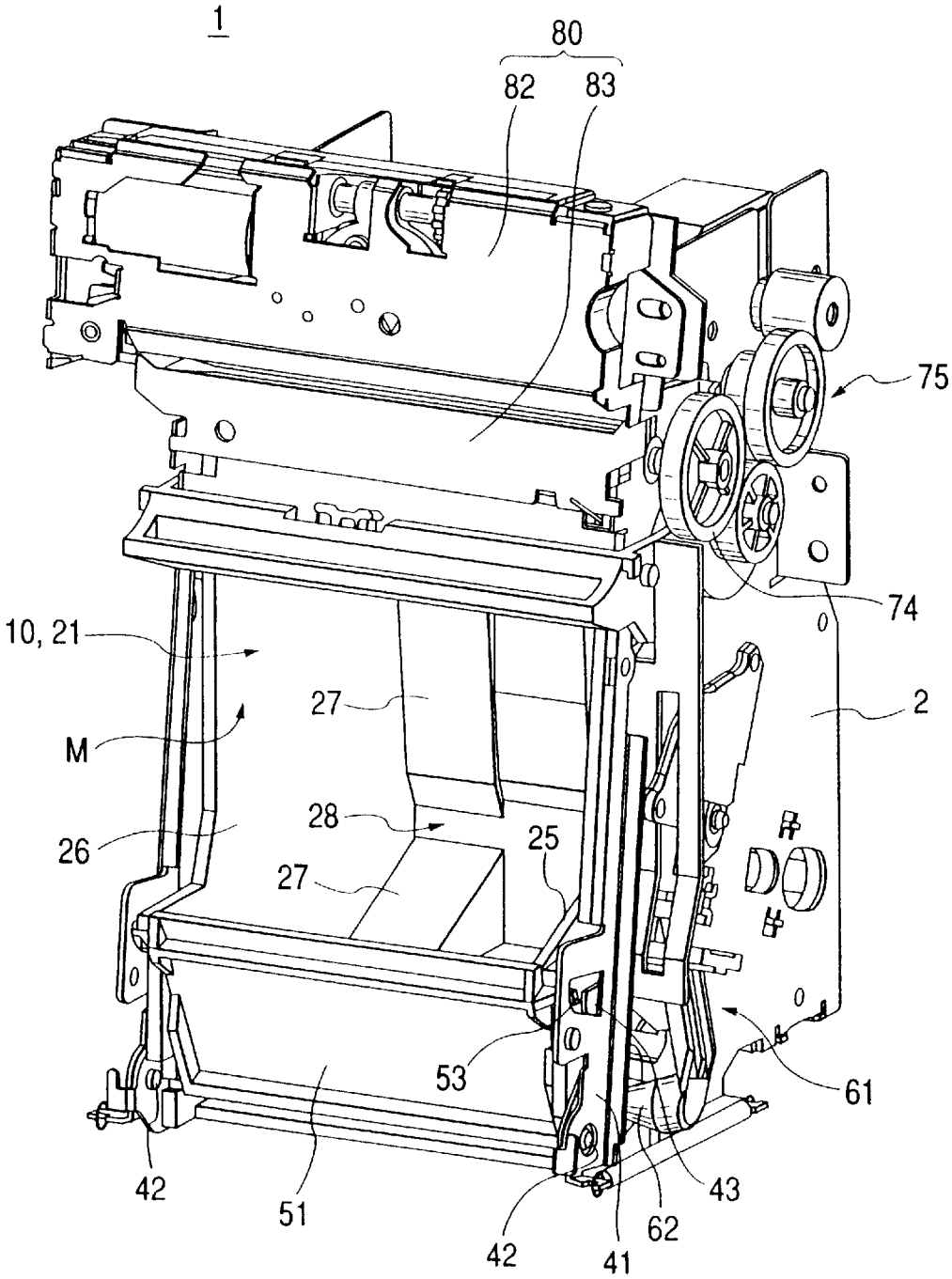
FIG. 1 is a perspective view, of a printer according to a preferred embodiment of the invention, showing the printer installed vertically with a holder cover that is closed.
Figure 2:
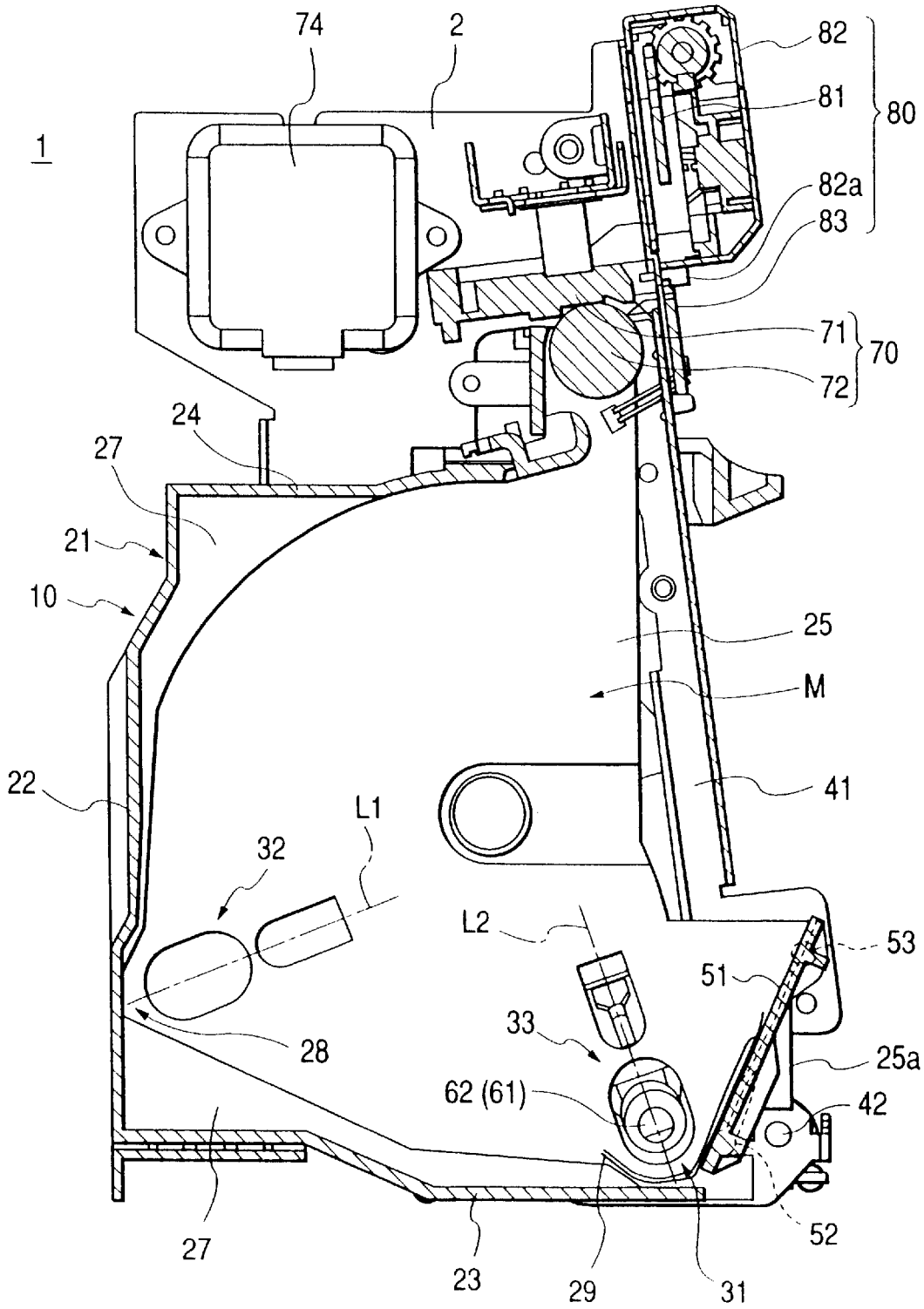
FIG. 2 is a side view, of the schematic structure of the printer, showing the printer installed vertically with a holder cover that is closed.
Figure 3:
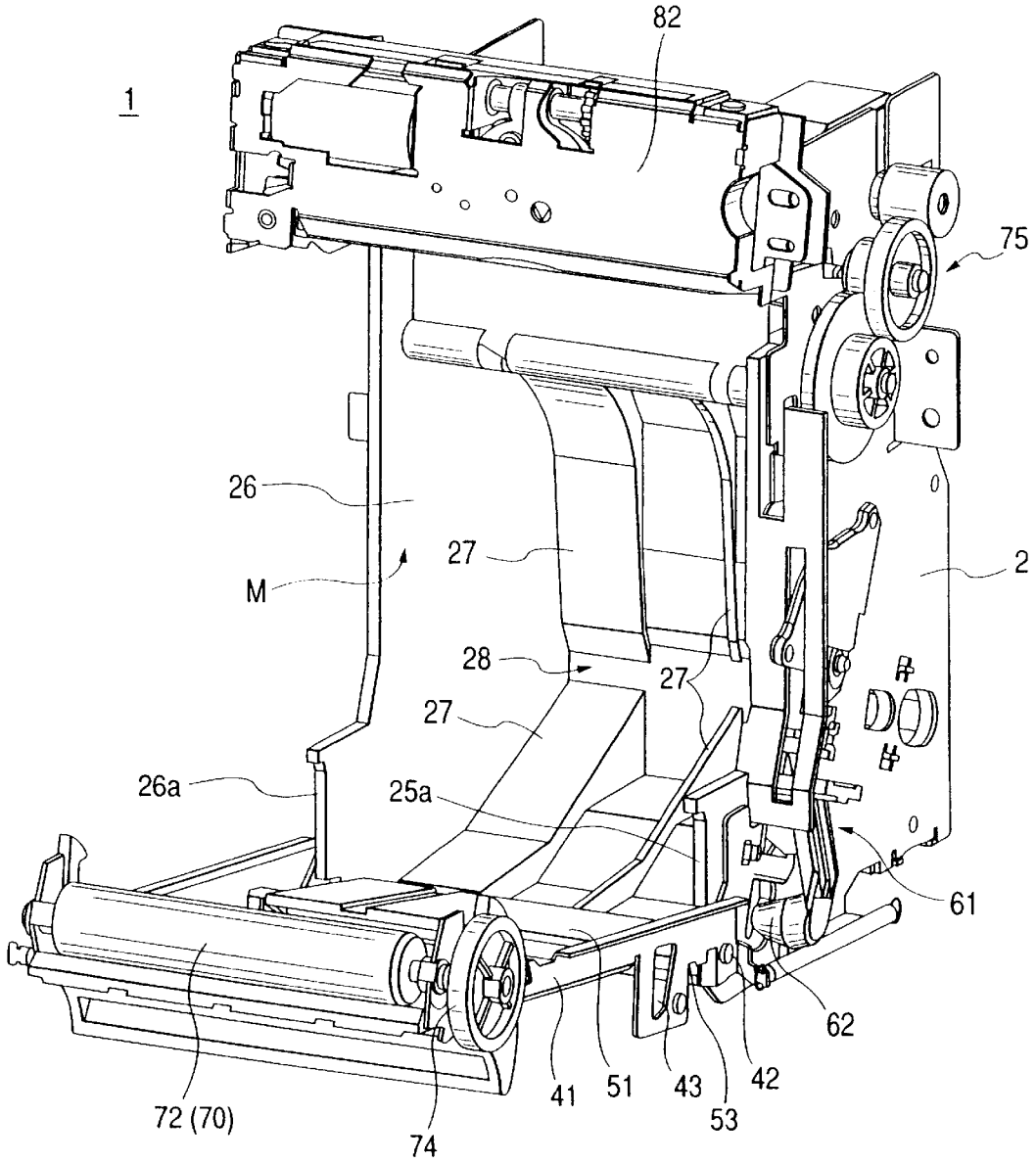
FIG. 3 is a perspective view, of the printer, showing the printer installed vertically with a holder cover that is opened.
Figure 4:
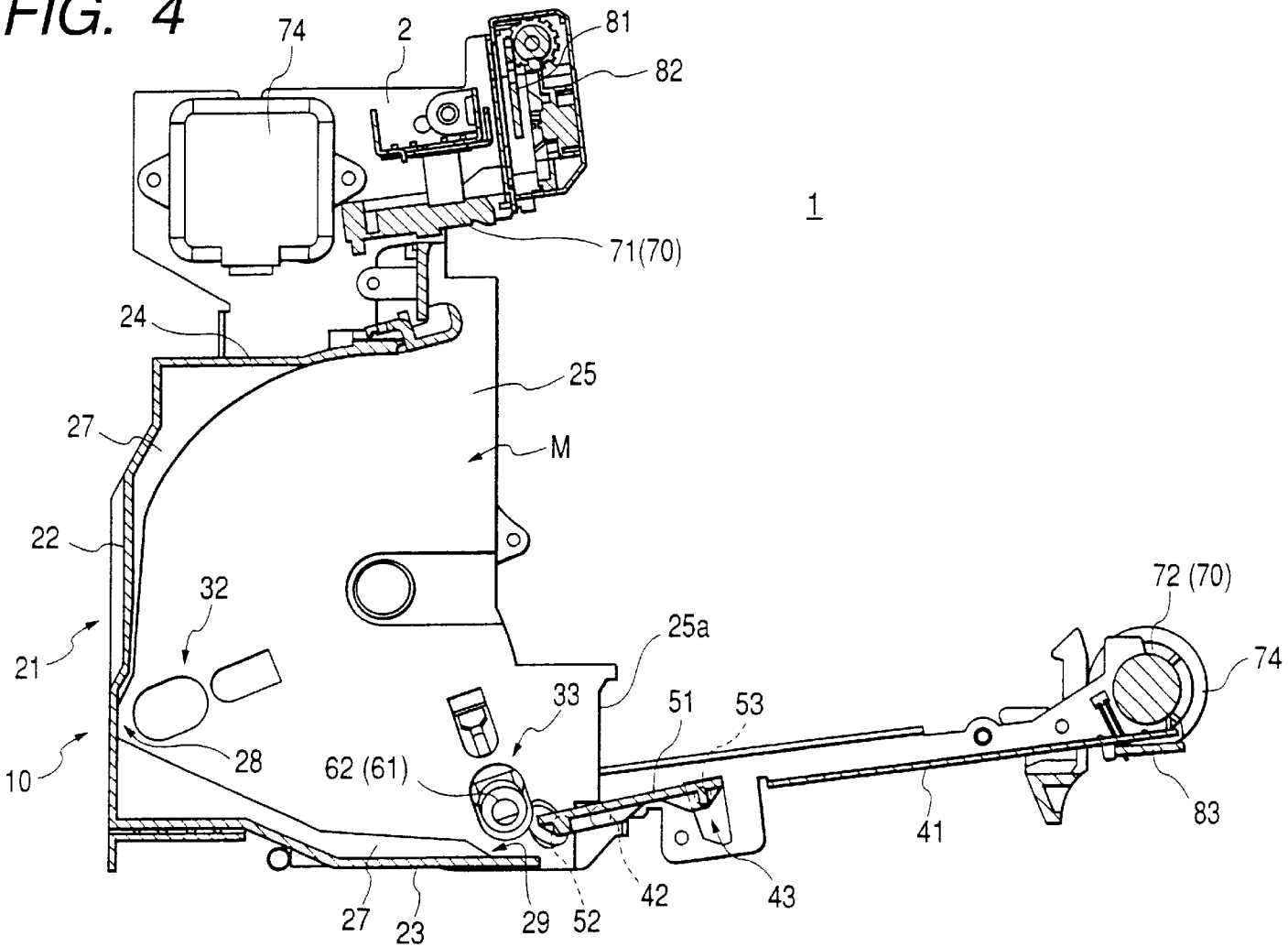
FIG. 4 is a side view, of the schematic structure of the printer, showing the printer installed vertically with a holder cover that is opened.
Figure 5:
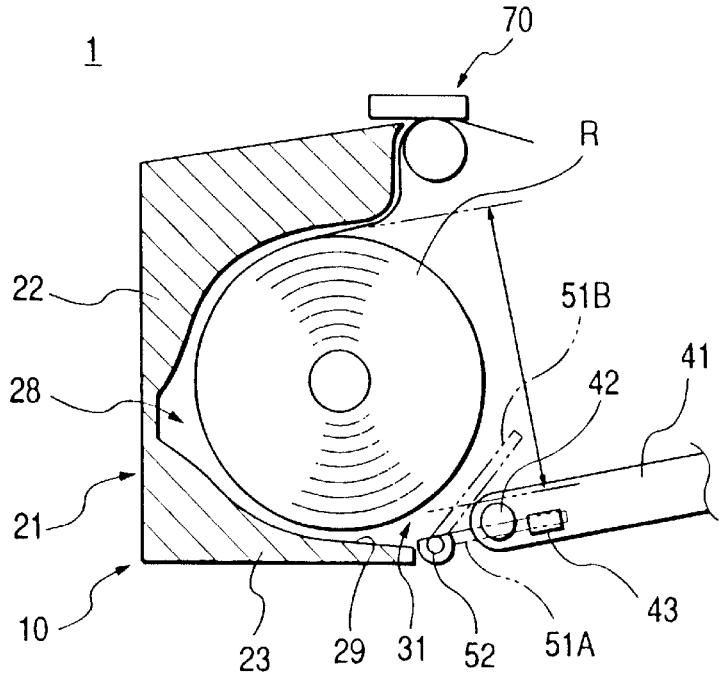
FIG. 5 is a schematic view showing rolled-paper stored in the printer.
Figure 6:
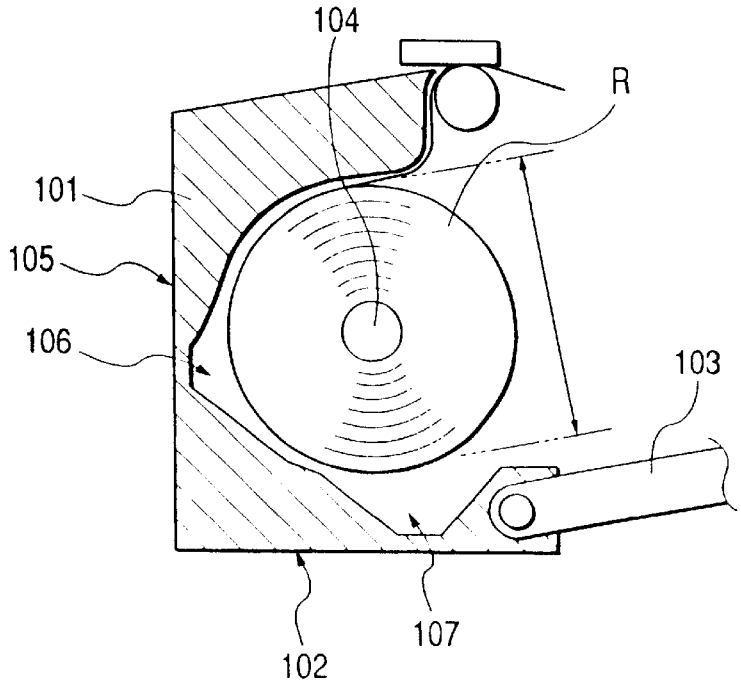
FIG. 6 (PRIOR ART)
FIG. 6 is a schematic view showing rolled-paper stored in a conventional printer.

FIG. 1 is a perspective view of a printer, according to a first embodiment, that is installed vertically, wherein a holder cover is closed. FIG. 2 is a schematic side view of the above printer, showing the printer installed vertically, wherein the holder cover is closed. Additionally, FIG. 3 is a perspective view showing the printer installed vertically wherein the holder cover is opened, whereas FIG. 4 is a schematic side view of the printer, showing a state in which the printer is installed vertically and the holder cover is opened. Further, FIG. 5 is a schematic view of a state in which rolled-paper is stored in a printer according to the present embodiment.

As shown in FIGS. 1 and 2, a printer 1 according to the present embodiment includes a rolled-paper holding mechanism 10 capable of storing rolled-paper R therein, a print device 70 for printing on the recording paper pulled out from the rolled-paper R, and a cutter device 80 for cutting the printed recording paper. The printer 1 according to the present embodiment further includes a main body case (not shown) having a substantially rectangular shape. In the side surfaces of the main body case, there are formed an installation surface for horizontal installation and an installation surface for vertical installation (both of which surfaces are not shown).

As shown in FIG. 2, the printer 1 includes a pair of main body frames 2, 2 which are made of metal and have a substantially rectangular-plate-like shape. Between these two main body frames 2, 2, there is interposed the above-mentioned rolled-paper holding mechanism 10. The rolled-paper holding mechanism 10 includes a rolled-paper holder 21, a holder cover 41, a retractable positioning member 51 in the form of a movable plate, and a residual-paper-quantity sensor 61.

The rolled-paper holder 21 is formed of resin, for example, and includes an opening M having a given size. The rolled-paper holder 21 is integrally formed of a bottom portion having a substantially U-shaped section and a pair of side wall portions 25, 26 respectively provided on the two sides of the bottom portion. In this embodiment, the bottom portion of the rolled-paper holder 21 includes three portions: the left-side portion as shown in FIG. 2 is referred to as a first bottom portion 22; the lower-side portion as shown in FIG. 2 is referred to as a second bottom portion 23; and the upper-side portion as shown in FIG. 2 is referred to as a third bottom portion 24.

In each of the first and second bottom portions 22 and 23, there is formed an inclined hold portion 27 which includes a curved surface and an inclined surface contactable with the rolled-paper R having the largest diameter. In the inclined hold portion 27 near the corner formed by the first bottom portion 22 and the second bottom portion 23, there is formed a second groove-like guiding portion 28 having a pair of inclined surfaces each having a given acute angle. The second groove-like guiding portion 28 can be contacted with the rolled-paper R having a given diameter. In the present embodiment, the given diameter is substantially equal to the diameter of the hollow core portion of the rolled-paper R. Similarly, in the inclined hold portion 27 in the leading end portion of the second bottom portion 23, there is formed a second-bottom-portion inclined surface 29 that is inclined at an angle which allows the inclined surface 29 to be contacted with the rolled-paper R having the above given diameter.

As shown in FIGS. 3 and 4, a holder cover 41 is disposed on the leading end side of the second bottom portion 23 of the rolled-paper holder 21. The holder cover 41 is disposed in such a manner that it can be freely rotated about a first pivot 42. Additionally, the holder cover 41 has such a size that allows the holder cover 41 to cover the opening M of the rolled-paper holder 21.

Also, as shown in FIG. 2, the retractable positioning member 51 is disposed in the corner portions of the main body frames 2, 2 near the leading end of the second bottom portion 23. The retractable positioning member 51 is disposed in such a manner that it can be freely rotated about a second pivot 52. Also, the retractable positioning member 51 is formed in a substantially rectangular plate having a length almost equal to the width of the rolled-paper holder 21.

The second pivot 52 is disposed in one longitudinal side portion of the retractable positioning member 51. Also, the second pivot 52 is situated at a position which is adjacent to the first pivot 42 of the holder cover 41, and is separated by a given distance from the leading end portion of the second-bottom-portion inclined surface 29.

On the other hand, in the retractable positioning member 51, in the longitudinal side portion opposite to that in which the second pivot 52 is disposed, there is disposed an engagement shaft 53 which can be engaged with part of the holder cover 41. The engagement shaft 53 is engaged with an engagement hole 43 formed at a given position of the side portion of the holder cover 41. Due to this arrangement, as the retractable positioning member 51 is moved in connection with the opening and closing operation of the holder cover 41, the inclination angle of the retractable positioning member 51 with respect to the second-bottom-portion inclined surface 29 is caused to vary.

As shown in FIGS. 1 and 2, when the holder cover 41 is closed, the retractable positioning member 51 is situated at a position which is inclined at a given acute angle with respect to the second-bottom-portion inclined surface 29. As shown in FIGS. 3 and 4, in the end edges of the side wall portions 25, 26 of the rolled-paper holder 21, there are respectively formed securing end edges 25*a*, 26*a* which are used to secure the retractable positioning member 51 in the above position; that is, in case where the engagement shaft 53 of the retractable positioning member 51 is held by and between the securing end edges 25*a*, 26*a* and the peripheral edge of the engagement hole 43 of the holder cover 41, the retractable positioning member 51 can be secured in the above position.

Also in the present embodiment, as shown in FIG. 2, between the retractable positioning member 51 and the second-bottom-portion inclined surface 29, there is formed a groove-like guiding portion 31 which can be engaged with the rolled-paper R having the above-mentioned given diameter.

As shown in FIGS. 3 and 4, the retractable positioning member 51 also is structured so that, when the holder cover 41 is opened, it is disposed so as to extend almost parallel to the side portion of the holder cover 41.

As shown in FIGS. 1 and 2, the residual-paper-quantity sensor 61 includes a projecting engagement portion 62 which can be pressed against the end face of the rolled-paper R. The sensor 61 is also structured such that, when the projecting engagement portion 62 is moved to thereby operate a limit switch (not shown), it can detect that the residual quantity of the recording paper is small.

As shown in FIG. 2, a first mounting hole 32 and a second mounting hole 33 are formed in one side wall portion 25 of the rolled-paper holder 21. The first mounting hole 32 and the second mounting hole 33 are used to mount the residual-paper-quantity sensor 61. The first mounting hole 32 is formed as an elongated hole having a major axis almost on the same line as the center line L1 of the second groove-like guiding portion 28. On the other hand, the second mounting hole 33 is formed as an elongated hole having a major axis almost on the same line as the center line L2 of the groove-like guiding portion 31.

When the residual-paper-quantity sensor 61 is mounted into either of the first mounting hole 32 or second mounting hole 33, as the diameter of the rolled-paper R decreases, the projecting engagement portion 62 is inserted through the first mounting hole 32 or second mounting hole 33 into the hollow core portion of the rolled-paper R disposed in the first positioning groove portion 28 or in the second positioning groove portion 31.

As shown in FIGS. 2 and 4, the printing device 70 includes a thermal head 71 capable of printing according to a heat sensitive method, and a platen roller 72 which can be contacted with the thermal head 71. The thermal head 71 is disposed on the main body frames 2, 2 and is situated in a peripheral portion of the leading end of the third bottom portion 24. On the other hand, the platen roller 72 is rotatably disposed in the leading end of the holder cover 41.

As shown in FIGS. 1 and 2, the printing device 70 is structured such that when the holder cover 41 is closed, the thermal head 71 and platen roller 72 are disposed opposite to, and pressed against, each other. Also, a gear 73, which is fixed to one side of the rotary support shaft of the platen roller 71, meshes with a plurality of gears in a train 75 which is disposed on the main body frame 2. Thus, when the power of a drive motor 74 is transmitted to the gear train 75, the platen roller 71 can be rotated.

As shown in FIGS. 1 and 2, the cutter device 80 is composed of a long fixed blade 83 and a movable blade unit 82. The movable blade unit 82 includes a movable blade 81, having a doorway portion 82*a*, which can be crossed and slid with respect to the fixed blade 83. Also, the movable blade unit 82 is disposed on the main body frame 2, 2 and is positioned on the paper-feed-direction downstream side of the neighboring portion of the thermal head 71. On the other hand, the fixed blade 83 is disposed in the leading end portion of the holder cover 41, and is disposed such that it can be oscillated slightly with respect to the movable blade 81.

Further, the cutter device 80 is structured such that, when the holder cover 41 is closed, the doorway portion 82*a* and the fixed blade 83 are opposed to each other, wherein the movable blade 81 crosses and slides on the fixed blade 83.

In the present embodiment having the above structure, when the printer 1 is installed vertically with the second bottom portion 23 of the rolled-paper holder 21 facing downward, as shown in FIG. 2, the residual-paper-quantity sensor 61 is mounted into the second mounting hole 33.

Next, as shown in FIGS. 4 and 5, the holder cover 41 is opened to thereby form, on the under side of the printer 1, a storing space which is substantially equal in size to the rolled-paper R having the largest diameter. In this case, as shown in FIG. 5, since the retractable positioning member 51 is situated at a position (the position of 51A shown by a one-dot chained line in FIG. 5) on the back side of the holder cover 42, the member 51 does not interfere with the rolled-paper R as is inserted into the rolled-paper holder 21.

And when the holder cover 41 is closed, the retractable positioning member 51 is rotated in connection with the rotation of the holder cover 41 so that, as shown in FIG. 2, the retractable positioning member 51 is secured to a position as indicated by 51B shown by a one-dot chained line in FIG. 5. When the retractable positioning member 51 is in the position 51B, the second positioning groove portion 31 is formed between the retractable positioning member 51 and the second-bottom-portion inclined surface 29.

In this case, while the retractable positioning member 51 is rotating, the rolled-paper R is pushed into the rolled-paper holder 21 and is secured there. Therefore, the rolled-paper R is held by and between the retractable positioning member 51 and the inclined hold portion 27 on the second bottom portion 23. On the other hand, a side-end face of the rolled-paper R is contacted by the projecting engagement portion 62 of the residual-paper-quantity sensor 61.

When printing, for example, the recording paper is pulled out from between the thermal head 71 and platen roller 72. Thus, even when the rolled-paper R attempts to move in the radial direction while rotating, the rolled-paper R is butted against the retractable positioning member 51; that is, the rolled-paper R is prevented from moving from the above-mentioned held position thereof.

Then, as the diameter of the rolled-paper R decreases during use, the hollow core portion of the rolled-paper R approaches the groove-like guiding portion 31. And when the recording paper becomes small in quantity, the rolled-paper R drops into the groove-like guiding portion 31, upon which the projecting engagement portion 62 is of the residual-paper-quantity sensor 61 is fitted into the hollow core portion of the rolled-paper R. Accordingly, the residual-paper-quantity sensor 61 detects that the residual quantity of the recording paper is small.

On the other hand, when the holder cover 41 is opened and the rolled-paper R is stored within the rolled-paper holder 21, as shown in FIG. 4, the rolled-paper R is stopped from rolling out of the rolled-paper holder 21. That is, a difference is produced between the support-shaft-longitudinal-side portion of the retractable positioning member 51 and the third-bottom-portion inclined hold portion 27, which difference prevents the rolled-paper R from rolling out from the rolled-paper holder 21.

Also in the present embodiment, when the printer 1 is installed horizontally with the first bottom portion 22 facing downward, the residual-paper-quantity sensor 61 is mounted into the first mounting hole 32. And after the holder cover 41 is opened, the rolled-paper R is inserted into the rolled-paper holder 21.

In this case, the rolled-paper R is contacted by the first-bottom-portion inclined hold portion 27 and the second-bottom-portion inclined hold portion 27.

Next, as the diameter of the rolled-paper R decreases due to use, the hollow core portion of the rolled-paper R approaches the second groove-like guiding portion 28. And when the recording paper wound around the hollow core portion of the rolled-paper R becomes small in quantity, the rolled-paper R drops into the second groove-like guiding portion 28. On the other hand, the projecting engagement portion 62 of the residual-paper-quantity sensor 61 is fitted into the hollow core portion of the rolled-paper R. Accordingly, the residual-paper-quantity sensor 61 detects that the residual quantity of the recording paper is small.

As has been described above, according to this embodiment, when the holder cover 41 is opened, the retractable positioning member 51 lays on the holder cover 41 side and, in case where the holder cover 41 is closed, the retractable positioning member 51 forms the second positioning (vertical-installation) groove 31. Due to this, there is no need to form a vertical-installation groove in the rolled-paper holder 21 as in the conventional mechanism. Thus, it is possible that only a storing space matched in size to the rolled-paper R having the largest diameter need be formed in the rolled-paper holder 21.

Accordingly, the rolled-paper holding mechanism 10 can be reduced in size, which in turn allows miniaturization of the printer 1 itself. Yet the printer 1 is still structured such that it is capable of detecting the residual quantity of the rolled-paper R in cases where the printer 1 is installed either horizontally or vertically.

Also, according to the present embodiment, since the rolled-paper holding mechanism 10 (including the above-mentioned retractable positioning member 51), the printing device 70, and the cutter device 80 are combined together, it is possible to miniaturize the printer 1, especially one which is used to issue a receipt.

As has been described above, both a rolled-paper holding mechanism capable of detecting the state of the residual quantity of the rolled-paper in both of horizontally and vertically installed states of a printer, and also a receipt issuing printer including such rolled-paper holding mechanism, can be reduced in size.

It is contemplated that numerous modifications may be made to the rolled-paper holding mechanism and printer of the present invention without departing from the spirit and scope of the invention as defined in the following claims.

What is claimed is:

1. A rolled-paper holding mechanism, comprising:

a rolled-paper holder capable of storing therein rolled-paper having a given diameter;

a holder cover disposed on said rolled-paper holder such that said holder cover can be opened and closed by moving about a first pivot;

a groove-like guiding portion formed in said rolled-paper holder, said rolled-paper being located on said groove-like guiding portion when said rolled-paper has a small diameter which is smaller than said given diameter;

a paper sensor for detecting a remaining amount of said rolled-paper, said paper sensor provided by the side of said groove-like guiding portion;

a retractable positioning member pivotally supported on a second pivot provided in the vicinity of said first pivot, said positioning member being movable together with said holder cover, and forming part of said groove-like guiding portion when said holder cover is closed.

2. A rolled-paper holding mechanism as set forth in claim 1, wherein said second pivot is provided at an end of said retractable positioning member, said rolled-paper holding mechanism further comprising:

an engagement shaft formed at an opposite end to said end of said retractable positioning member, an engagement hole provided with said holder cover, said engagement shaft being engaged in said engagement hole.

3. A rolled-paper holding mechanism as set forth in claim 2, wherein said rolled-paper having said small diameter is located on said groove-like guiding portion when said rolled-paper holding mechanism is mounted in a vertical attitude, said rolled-paper holding mechanism further comprising a second groove-like guiding portion formed in said rolled-paper holder, wherein said rolled-paper having said small diameter is located on said second groove-like guiding portion when said rolled-paper holding mechanism is mounted in a horizontal attitude.

4. A rolled-paper holding mechanism as set forth in claim 1, wherein said rolled-paper having said small diameter is located on said groove-like guiding portion when said rolled-paper holding mechanism is mounted in a vertical attitude, said rolled-paper holding mechanism further comprising a second groove-like guiding portion formed in said rolled-paper holder, wherein said rolled-paper having said small diameter is located on said second groove-like guiding portion when said rolled-paper holding mechanism is mounted in a horizontal attitude.

5. A printer, comprising:

a rolled-paper holding mechanism as set forth in claim 1, and a printing mechanism adapted to print on recording paper pulled out from said rolled-paper held in said rolled-paper holder.

6. A printer as set forth in claim 5, further comprising:

a cutting mechanism that is adapted to cut said recording paper after said recording paper has passed through said printing mechanism.

7. A rolled-paper holding mechanism, comprising:

a rolled-paper holder capable of storing therein rolled-paper having a given diameter, said rolled-paper holder being mountable in a vertical attitude and a horizontal attitude;

a holder cover disposed on said rolled-paper holder such that said holder cover can be opened and closed by moving about a first pivot;

a vertical attitude groove-like guiding portion and a horizontal attitude groove-like guiding portion formed in said rolled-paper holder, said rolled paper being located on said vertical or horizontal groove-like guiding portions, depending on an attitude of said mechanism, when said rolled-paper has a small diameter which is smaller than said given diameter; and a retractable positioning member pivotally supported on a second pivot provided in the vicinity of said first pivot, said positioning member being movable together with said holder cover, and forming part of one of said vertical attitude groove-like guiding portion or said horizontal attitude groove-like guiding portion when said holder cover is closed.

8. A rolled-paper holding mechanism according to claim 7, wherein said second pivot is provided at an end of said retractable positioning member, said rolled-paper holding mechanism further comprising:

an engagement shaft formed at an opposite end to said end of said retractable positioning member, an engagement hole provided with said holder cover, said engagement shaft being engaged in said engagement hole.

* * * * *